United States Patent [19]

Fitch

[11] Patent Number: 4,625,668

[45] Date of Patent: Dec. 2, 1986

[54] LAST DITCH DEFENCE PROCESS

[76] Inventor: William B. Fitch, Naval Chaplain school, NETC, Newport, RI 02841

[21] Appl. No.: 551,605

[22] Filed: Nov. 14, 1983

[51] Int. Cl.[4] ..... B63G 9/04

[52] U.S. Cl. ..... 114/14

[58] Field of Search ..... 114/1, 9–14, 114/5, 15, 175, 261, 262

[56] References Cited

U.S. PATENT DOCUMENTS

| | | | |
|---|---|---|---|
| 419,301 | 1/1890 | Abraham | 114/14 |
| 498,679 | 5/1893 | McDougall | 114/9 |
| 687,398 | 11/1901 | Garrigues | 114/12 |
| 1,305,296 | 6/1919 | Mackay | 114/15 |
| 1,410,820 | 3/1922 | McMillan | 114/14 |
| 1,713,339 | 5/1929 | Holden | 114/14 |
| 2,381,534 | 8/1945 | Frederick | 114/14 |
| 2,807,429 | 9/1957 | Hawkins et al. | 114/261 |
| 4,501,215 | 2/1985 | Hart | 114/39 |
| 4,516,519 | 5/1985 | Gulick | 114/39 |
| 4,534,305 | 8/1985 | Lecompte | 114/39 |

*Primary Examiner*—Trygve M. Blix
*Assistant Examiner*—Stephen P. Avila

[57] ABSTRACT

A set of three shield devices in which a monohulled war vessel is defended against projectiles. The devices being deployed aft of the helicopter hangar, centered on the fore and aft longitudinal axis of the hull. The devices capable of activation for projectile deflection in any configuration or independently. Further, the structure of the shields is composed of suitable plastic materials.

1 Claim, 13 Drawing Figures

LAST DITCH DEFENCE PROCESS

BACKGROUND OF THE INVENTION

Many monohull warships are subject to being sunk by high velocity projectiles inasmuch as they do not include deflection devices with their other methods of defence. Accordingly, and particularly when smaller warships are under attack, considerable danger exist in the event of shrapnel causing complex defence methods to fail. Accordingly, a need exist for structural devices by which a small warship may resist to the point of sinking as a result of high velocity projectiles.

Although various forms of defensive structures designed to prevent projectile penetration of monohull warships heretofore have been provided, most of these previously known structures are relatively complex and heavy and are not readily adaptable to existing hulls. While the problem mentioned above is a very long standing one, a practical solution has not previously been devised insofar as the applicant is aware. Examples of previously known forms of defensive structures for preventing projectile penetration and sinking and which include some of the general structural and operational features of the instant invention but none is believed to be pertinent to the present invention are disclosed in U.S. Pat. Nos. 1,305,296; 1,713,339; 1,410,820; 2,807,429; 419,301.

BRIEF DESCRIPTION OF THE INVENTION

The shield devices of the mechanical projectile defence apparatus are used in conjunction with the compass bearing of the nearest projectile. Upon reception of the projectile's bearing the small warship is pivoted on its vertical axis, port or starbord, to the reciprocal bearing of the projectile, and a deflection structure on the stern is selected and engaged. After projectile contact with one of the three deflection devices, the bow is swung to the reciprocal bearing of the next closest projectile and so forth and so on until the threat is over.

The main objective of this invention is to provide a mechanical projectile defence apparatus relative to the mission function of the hull design.

Another object of this invention is to provide a mechanical projectile defence apparatus in accordance with and in addition to preceding defence methods and wherein said structures are provided for retraction from an upright position after threat analysis and which thereby facilitate restoring the aft portion of warship to peace time status.

Still another important object of this invention is to provide a deflection capability without interruption of aircraft operations.

Further another important object of this invention is to provide a mechanical projectile defence apparatus in accordance with preceding hull designs and wherein the mechanical projectile defence apparatus is carried by the aft portion of the hull and thereby may be readily retrofitted to existing small warships as well as incorporated in the construction of new warships.

A final object of this invention to be specifically enumerated herein is to provide a mechanical projectile defence apparatus in accordance with the preceding objects and which will conform to conventional forms of manufacture be of simple construction and easy to use so as to provide devices that will be economically feasible, long lasting and relatively trouble free in operation.

These together with other objects and advantages which will become subsequently apparent reside in the details of construction and operation as more fully herein after described and claimed, reference being had to the accompanying drawings forming a part hereof, wherein like numerals refer to like parts throughout.

DETAILED DESCRIPTION OF THE INVENTION

Having reference now to the drawings, the numeral 1 generally illustrates the helicopter deck of a small warship. The numeral 2 illustrates the helicopter hangar. Furthermore the numeral 6 is the stern of the warship.

Figure 1:
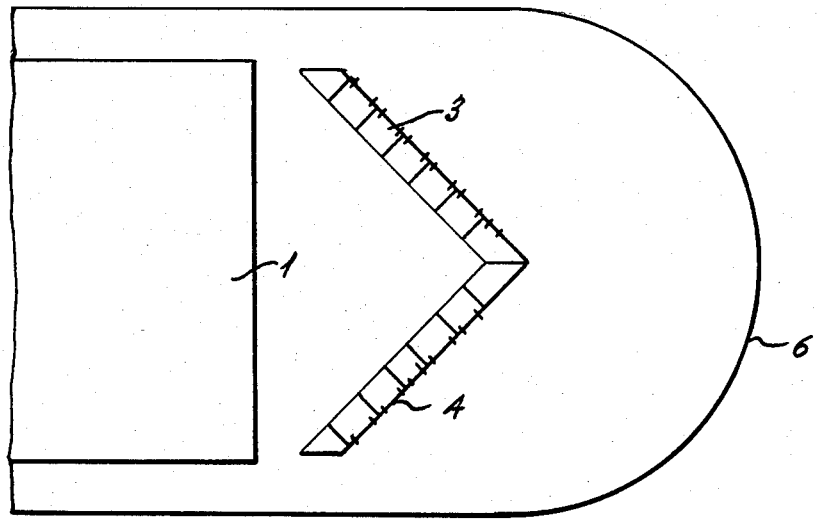
FIG. 1 is a top view of a typical formed stern of a warship hull equipped with hatches mounted over the aperature to the stage one shield deflection device.
Figure 2:
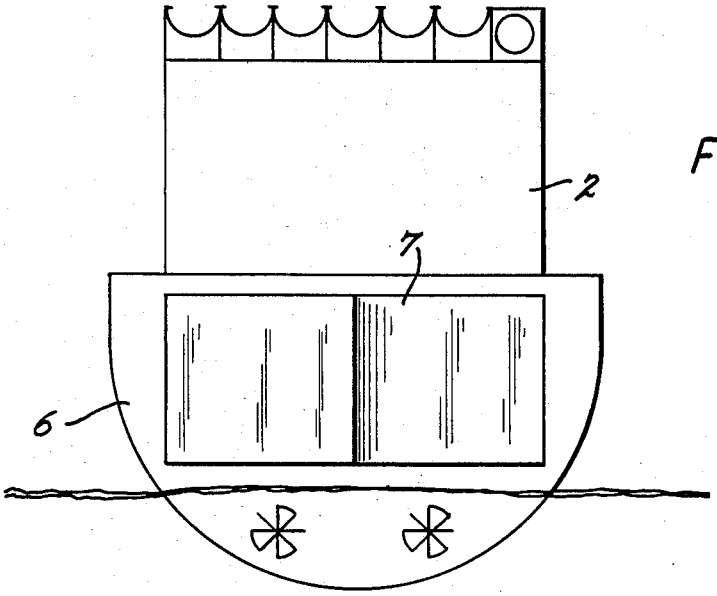
FIG. 2 is a transverse vertical sectional view of the stage one shield deflection device in a downward position.
Figure 3:
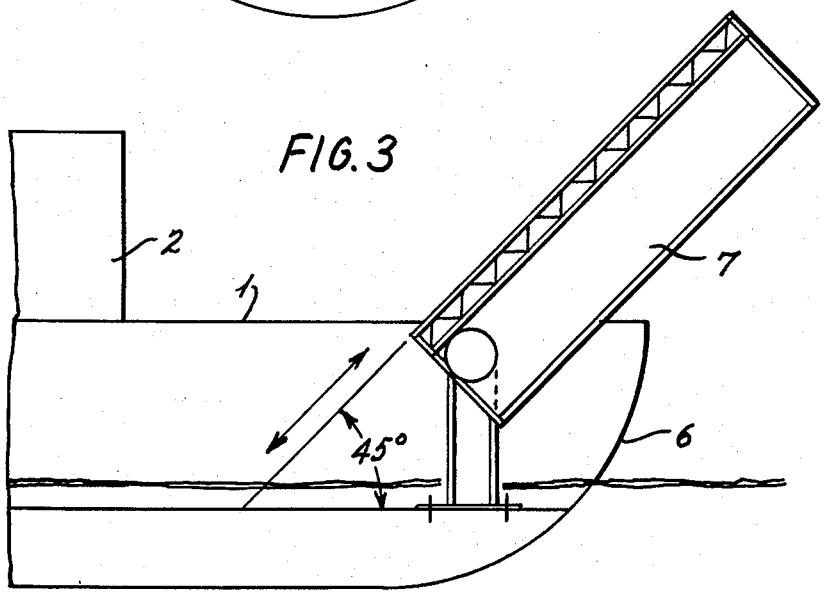
FIG. 3 is a stern side elevational view of the stage one shield device in an upward position.
Figure 4:
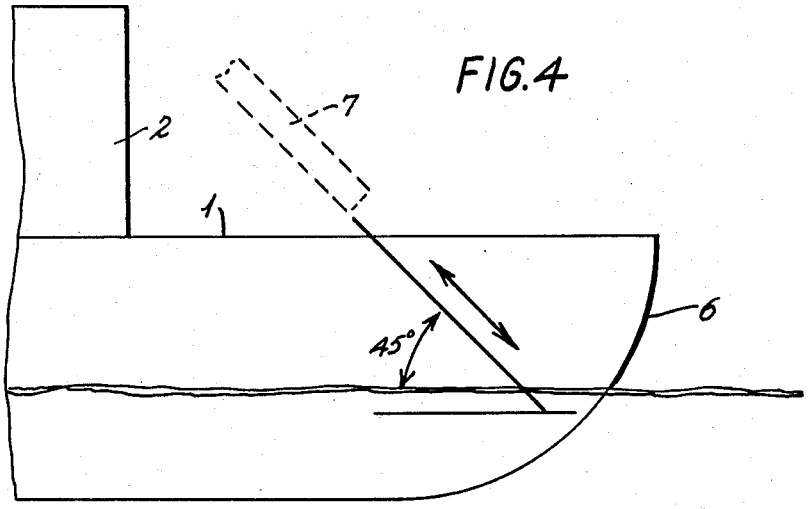
FIG. 4 is a stern side elecational view of the stage one shield device in an optional position.
Figure 5:
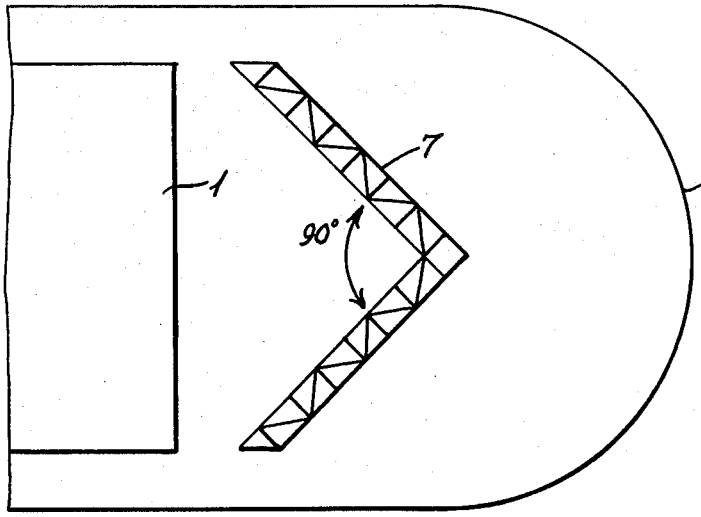
FIG. 5 is a top view of the internal bracing of the stage one shield device.

The hinged 3 hatches 4 are to be aperature of a stage one shield device as best seen from FIG. 2. It is formed of two braced plates mounted at a right angle with respect to each other 7 and being stored below the helicopter deck on a lower internal deck, the shield 7 having a gear rack, the shield 7 being deployed at a 45° angle with respect to the helicopter deck by a pinion gear mounted on a support on the lower internal deck. The shield 7 includes a guide support 17 for the leading edge.

Figure 7:
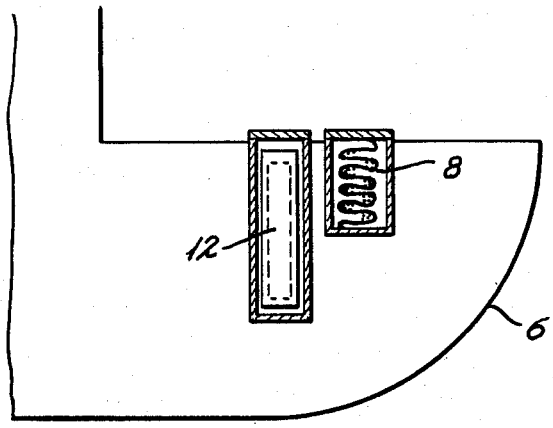
FIG. 7 is a stern side elevational view of the stage two shield device in a downward (stored) position.
Figure 6:
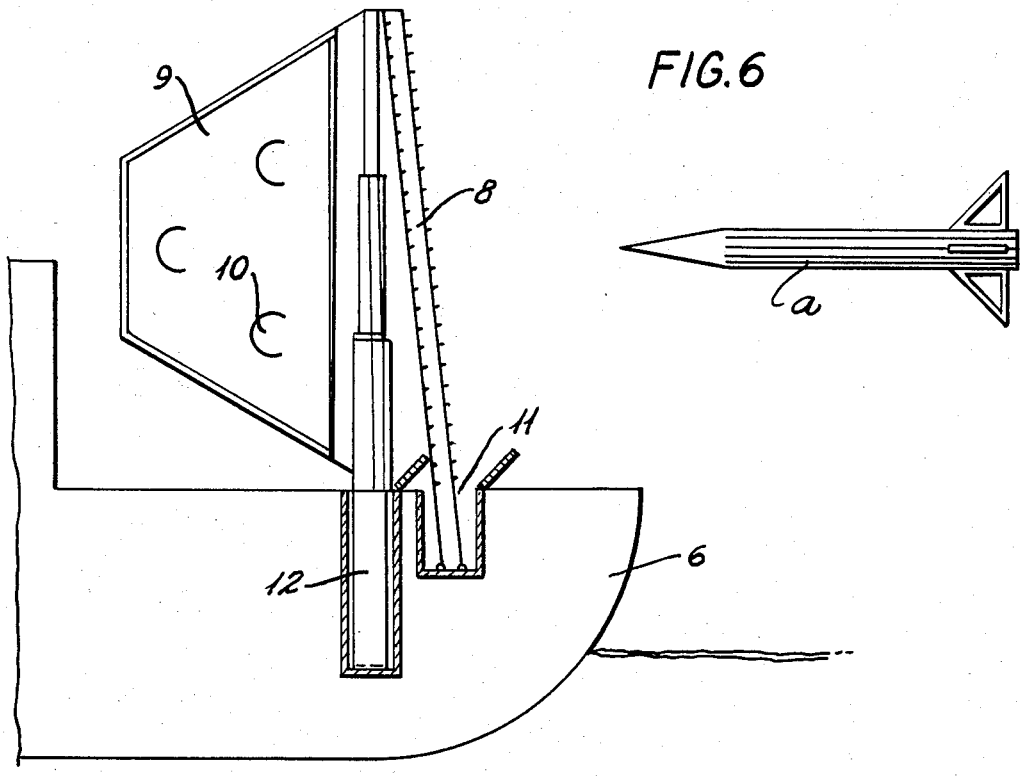
FIG. 6 is a stern side elevational view of the stage two shield device in an upward position.
Figure 8:
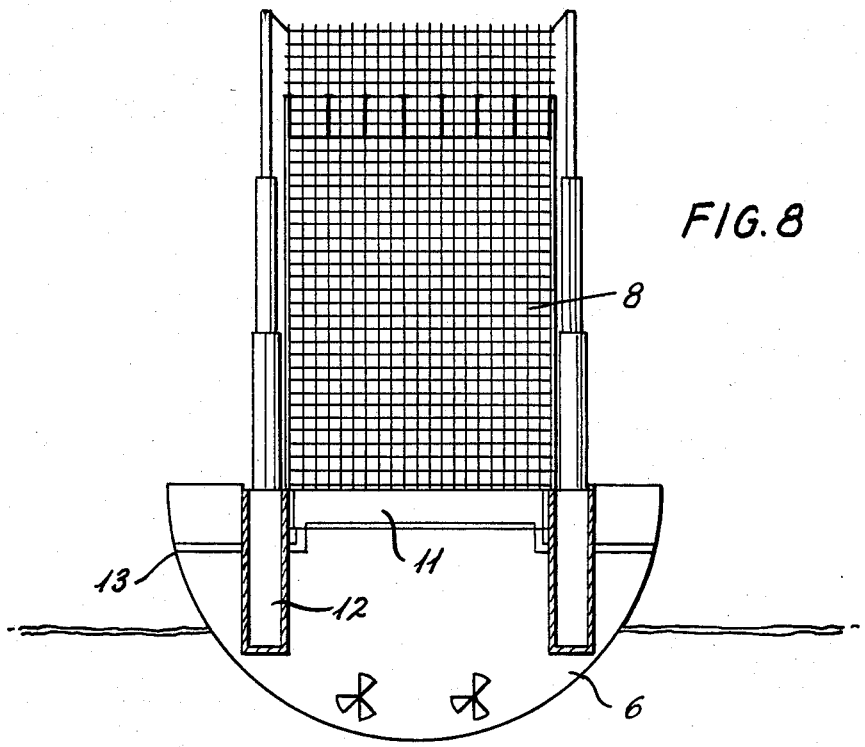
FIG. 8 is a transverse vertical sectional view of the stage two shield device in an upward position.

According to the invention a stage two shield device as shown more particularly in FIGS. 6–8 of the accompanying drawings is constituted in the form of two steel nets 8 and a fabric trap 9, the trap being three dimensional in shape and having air vents 10, the nets being located forward of the trap, the nets and trap extending to a level above the helicopter hangar 2 when deployed, the nets 8 and trap 9 being stored in a locker 11 (FIG. 7)

with a lid and drains 13 below the helicopter deck 1 and the nets 8 and trap 9 being deployed by two lift cylinders 12 which cylinders are stored below the helicopter deck 12 (FIG. 7). In FIG. 6 by way of example, a projectile (a) illustrates the direction in which it would enter the nets and trap.

Figure 9:
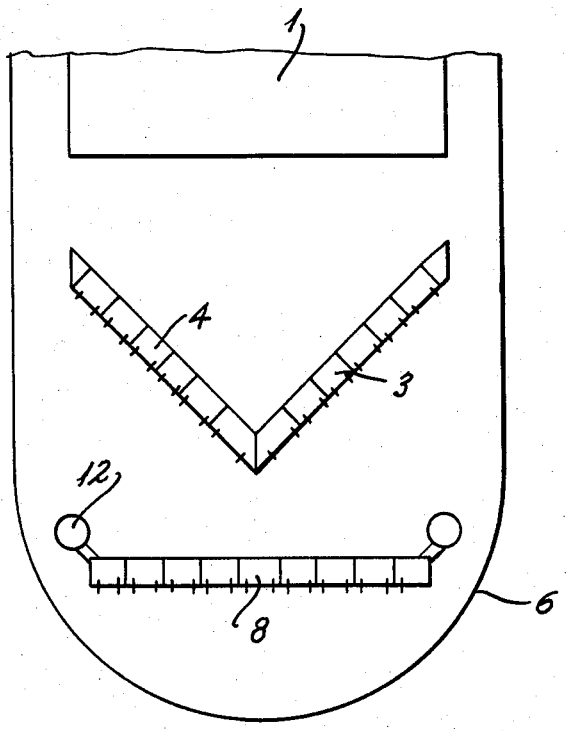
FIG. 9 is a sectional top view of the stern illustrating the relationship of the apertures of the stage one shield device to the stage two shield device.

While the invention has been described so far with reference to a stage one and a stage two shield devices, FIG. 9 points out their relative sites on the stern. The lift cylinders 12 are covered with hinged lids.

Figure 10:
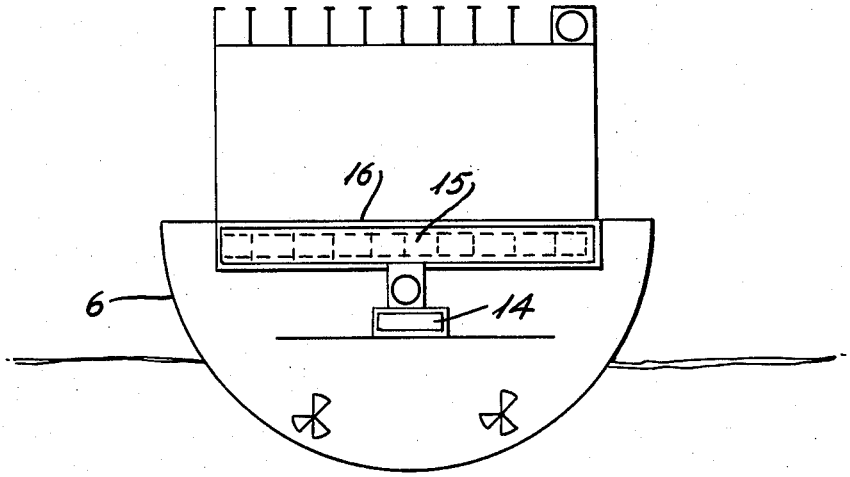
FIG. 10 is a transverse vertical sectional view of the stage three shield device in the downward position.
Figure 11:
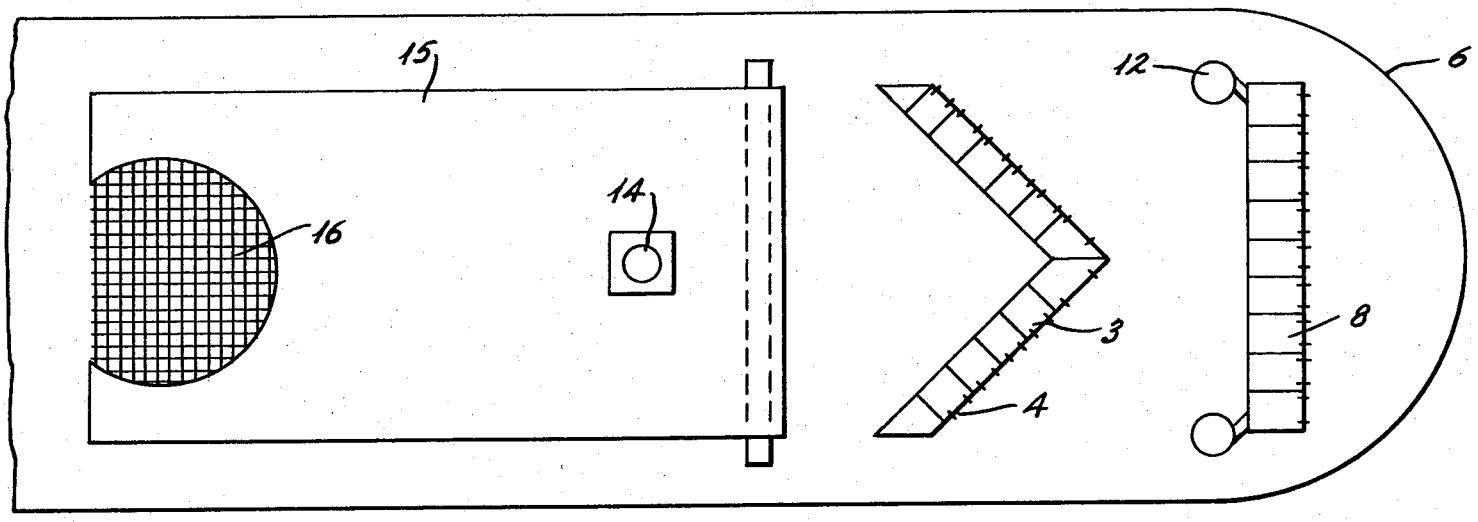
FIG. 11 is a stern sectional top view of the stage three shield device in the downward position showing its relative position to the stage one shield device and the stage two shield device.
Figure 13:
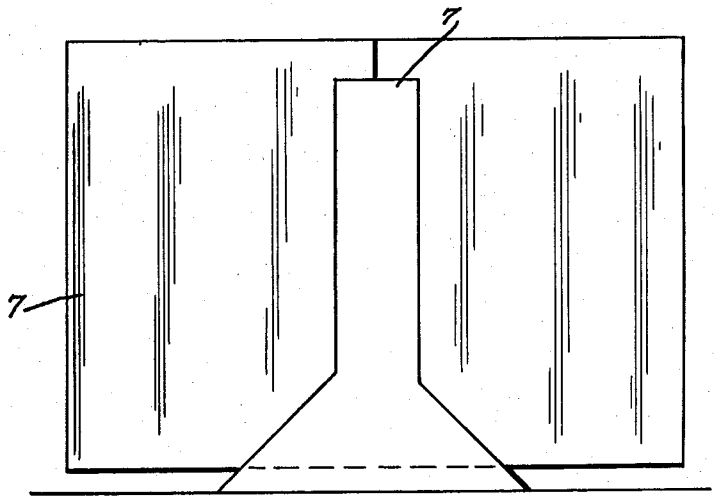
FIG. 13 is an enlarged side and front elevational view of the leading edge support to the stage one shield device.
Figure 12:
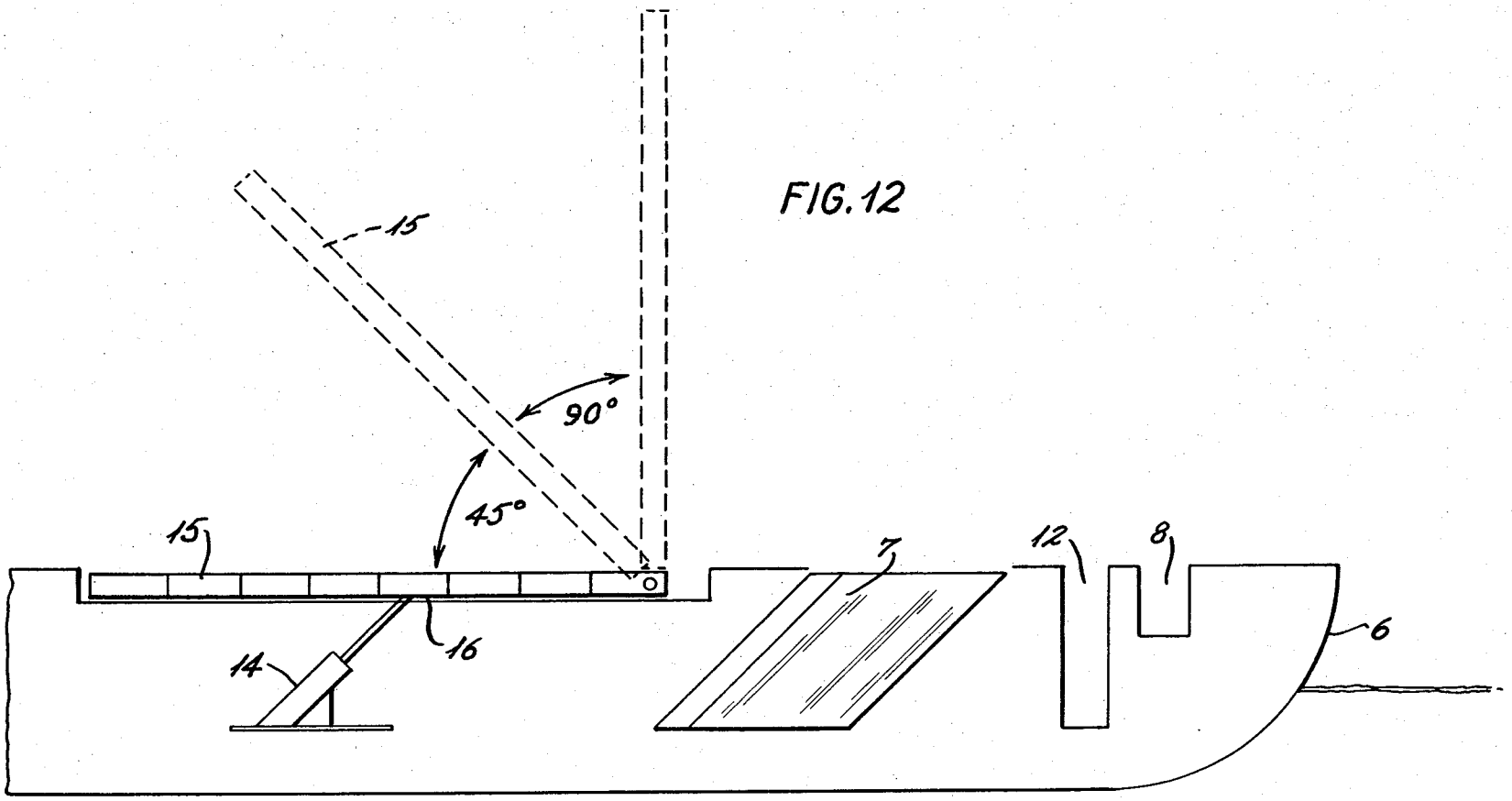
FIG. 12 is a slide elevational view of the stage three shield device illustrating the manner in which it can be pivoted to account for aircraft operations.

FIGS. 10–12 are considered as illustrative of a stage three shield device in the form of a reinforced deck 15, the shield primarily functioning as the helicopter deck when stored and the shield being pivotally mounted to be deployed from up and around the landing grating 16 by a lift cylinder 14.

For use in combination with aircraft operations and projectile threat, FIG. 12 illustrates that a stage three shield device may be pivoted from a deployed position of 45° to an upright position of 90° to allow an aircraft to land.

The foregoing description is considered as illustrative only of the principles of the invention. Further, since numerous modifications and changes will readily occur to those familiar and skilled in the art, it is not desired to limit the invention to the exact construction and operation shown and described, and accordingly, all suitable modifications may be restorted to, without departing from the spirit or essential characteristics.

By virtue of the invention it will be apparent the mechanical projectile defence apparatus provides a novel, defensive, auxiliary apparatus for a warship which enable the ship, captain, and crew more protection than has heretofore been possible.

What is claimed is:

1. A mechanical projectile defence apparatus for a ship which comprises:

a helicopter hangar;

a helicopter deck;

a secondary helicopter deck;

a lower internal deck;

a stage one shield in the form of two braced plates mounted at a right angle with respect to each other and being stored below the helicopter deck on the lower internal deck, the shield having a gear rack, the shield being deployed at a 45 degree angle with respect to the helicopter deck by a pinion gear mounted on a support on the lower internal deck;

a stage two shield in the form of two steel nets and a fabric trap, the trap being three dimensional in shape and having air vents, the nets being located forward of the trap, the nets and trap extending to a level above the helo hangar when deployed, the nets and trap being stored in a locker with a lid and drains below the helicopter deck, and the nets and trap being deployed by two lift cylinders which cylinders are stored below the helicopter deck;

a stage three shield in the form of a reinforced deck, the shield primarily functioning as the helicopter deck when stored and the shield being pivotally mounted to be deployed by a lift cylinder;

and all three of said shields being deployed aft of the helicopter hangar with the stage two shield being the rearmost and the stage three shield being the foremost.

* * * * *